US005743781A

United States Patent [19]

Lee

[11] Patent Number: 5,743,781

[45] Date of Patent: Apr. 28, 1998

[54] ORNAMENTAL TOY CAPABLE OF RUNNING UP AND DOWN

[75] Inventor: Sam Lee, Taipei, Taiwan

[73] Assignee: Studio Eluceo Ltd., Taipei, Taiwan

[21] Appl. No.: 723,362

[22] Filed: Sep. 30, 1996

[51] Int. Cl.[6] ..... A63H 11/04

[52] U.S. Cl. ..... 446/315; 446/353; 446/490

[58] Field of Search ..... 446/314, 315, 446/444, 445, 490, 330, 353

[56] References Cited

U.S. PATENT DOCUMENTS

| | | | |
|---|---|---|---|
| 2,064,119 | 12/1936 | Irenius | 446/315 |
| 3,916,548 | 11/1975 | Langer | 446/315 |
| 3,930,333 | 1/1976 | De Anda | 446/445 |
| 4,056,896 | 11/1977 | Karasawa | 446/315 |
| 4,143,482 | 3/1979 | Meyer eta l. | 446/172 |
| 4,183,172 | 1/1980 | Lewis et al. | 446/172 |

FOREIGN PATENT DOCUMENTS

| | | | |
|---|---|---|---|
| 38179 | 4/1965 | Netherlands | 446/445 |

*Primary Examiner*—Robert A. Hafer
*Assistant Examiner*—Jeffrey D. Carlson
*Attorney, Agent, or Firm*—Beveridge, DeGrandi, Weilacher & Young LLP

[57] ABSTRACT

Disclosed is an ornamental toy capable of running up and down mainly including a driving mechanism wrapped up by the ornamental toy and a long bead string extending through the driving mechanism. The driving mechanism includes a motor rotating a driving wheel of a clamp wheel set, so that beads of the string passing through the driving wheel set are received in recesses formed on the driving wheel and are clamped between said driving wheel and an idler of the clamp wheel set, allowing the driving mechanism wrapped in the ornamental toy to climb along the bead string. Since the idler is co-axially connected to a link which will be pushed outward by a cam connected to a reduction gear set actuated by the motor, the idler will be moved away from the driving wheel at a fixed interval due to the contact of the cam with the link, causing the clamp wheel set to disengage from the bead string, allowing the driving mechanism within the ornamental toy to slide down along the bead string.

8 Claims, 5 Drawing Sheets

ORNAMENTAL TOY CAPABLE OF RUNNING UP AND DOWN

BACKGROUND OF THE INVENTION

1. Field of the Invention

The present invention relates to an ornamental toy, and more particularly to an ornamental toy which can automatically run up and down along a long string of beads and is therefore very interesting.

2. Description of the Prior Art

Most of the ornamental toys, specially toys for Christmas holidays, such as Santa Claus, Angels, sledge with deer, etc., have almost the same designs and are stationarily fixed to a certain position, though some of them are designed to have turnable head, swing hands and/or wings.

There are also some prior patented designs of motor-equipped ornaments connected to some ornamental light strings to achieve a dynamic visual effect. These ornaments, however, can not largely shift in their position to create more funs.

SUMMARY OF THE INVENTION

It is a primary object of the present invention to provide an ornamental toy which can largely shift up and down along a long string of beads to create novel and unique decorative effect.

Another object of the present invention is to provide an ornamental toy which can be connected to light strings, such that when the toy shifts up and down along the long string of beads, the light strings are brought to move along the toy and create special decorative effect.

In another embodiment of the present invention, the ornamental toy is fixed in a point while the long string of beads is movable up and down.

BRIEF DESCRIPTION OF THE DRAWINGS

The structural features and the manner of operation of the present invention can be best understood by referring to the following detailed description of the preferred embodiments and the accompanying drawings, wherein.

DETAILED DESCRIPTION OF THE PREFERRED EMBODIMENTS

Figure 1:
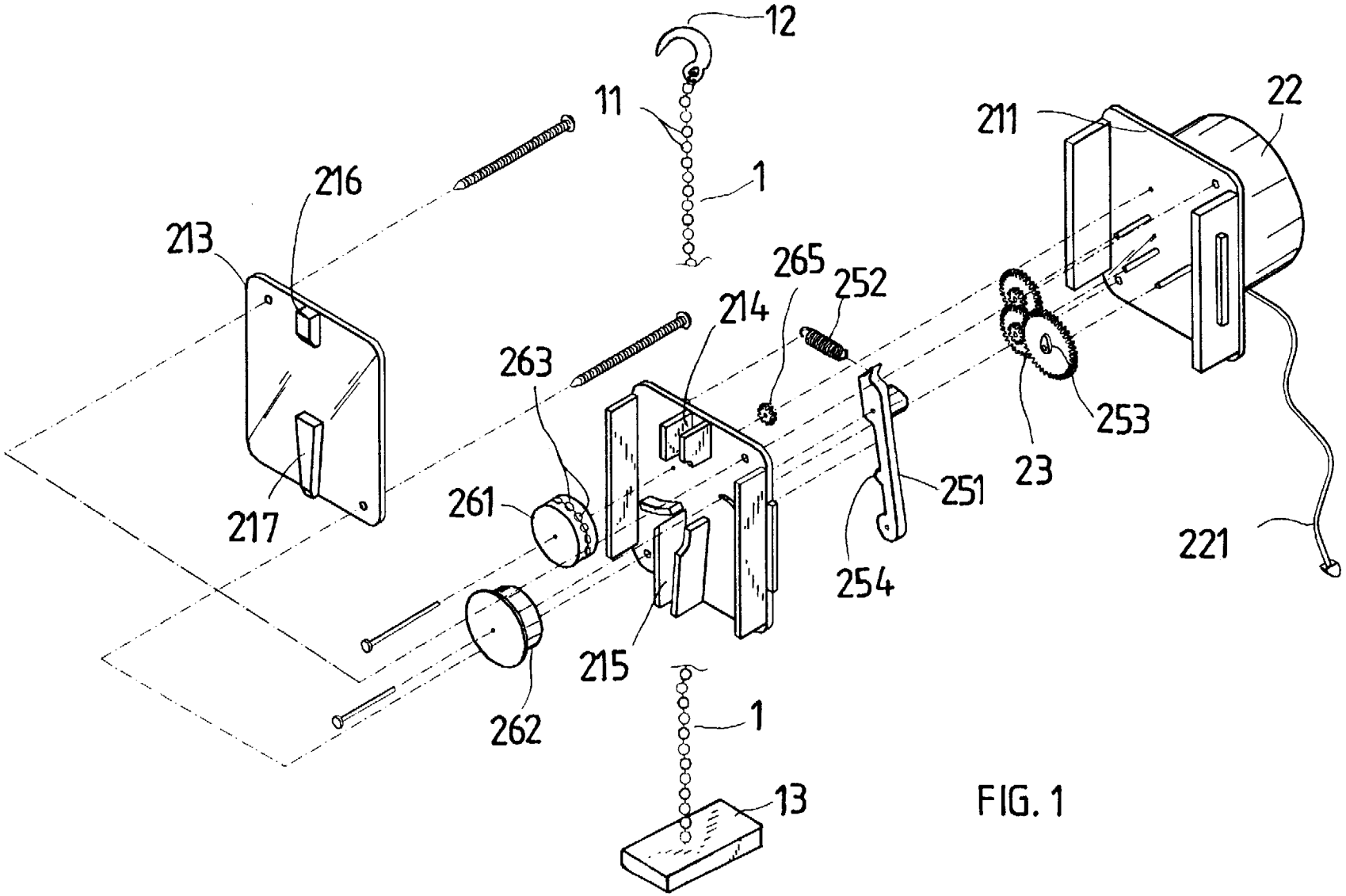
FIG. 1 is an exploded perspective of a driving mechanism of the present invention.
Figure 2:
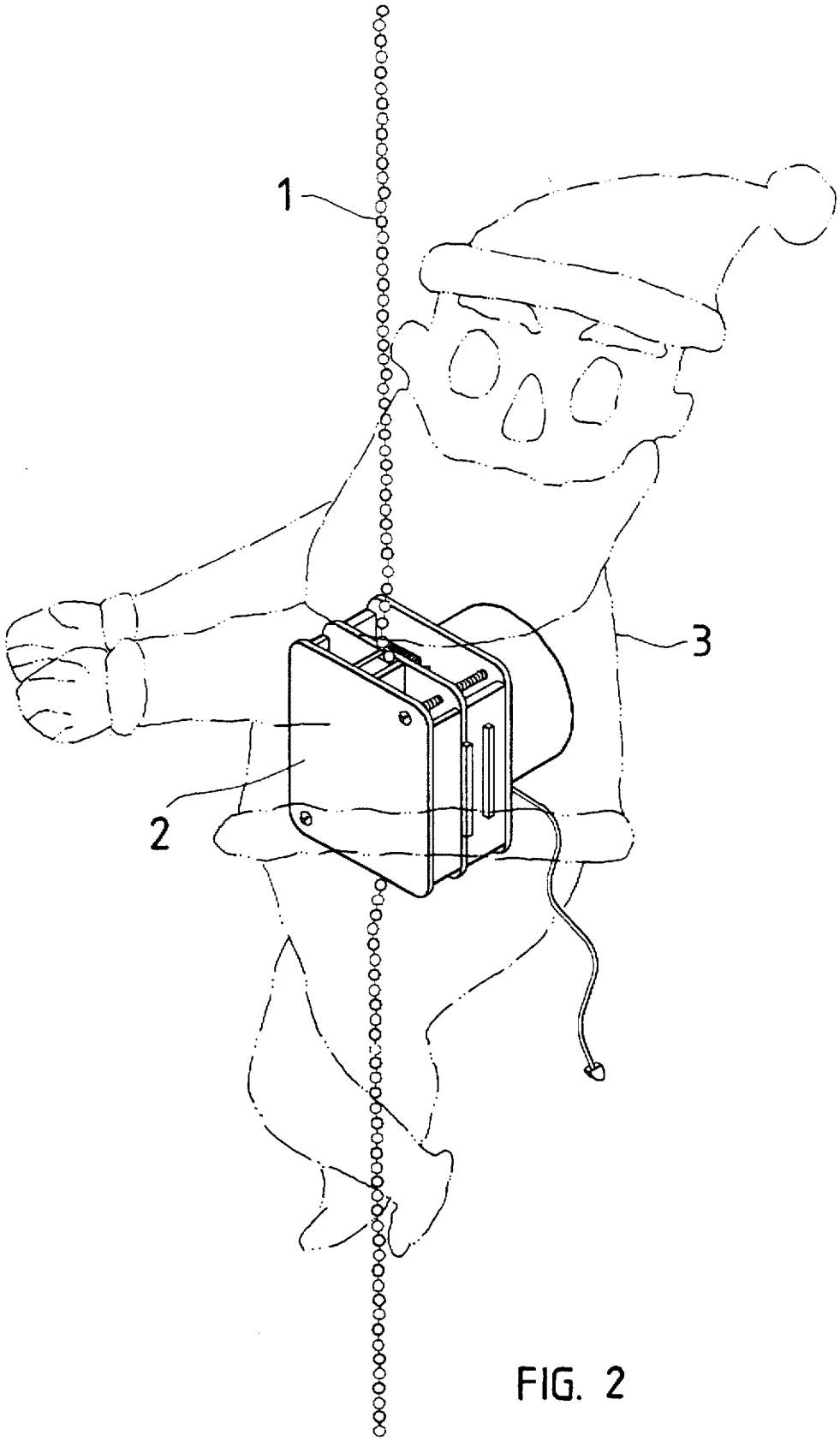
FIG. 2 shows an application of the assembled driving mechanism in an ornamental toy Santa Claus.

Please refer to FIGS. 1 and 2. The present invention mainly includes a long string of beads 1, a driving mechanism 2, and an ornamental toy 3 wrapping up the driving mechanism 2 therein.

The long string of beads 1 is formed from a plurality of round beads 11 serially connected together.

The driving mechanism 2 mainly includes an electric motor 22, a first base board 211 to which the motor 22 is fixed, a second base board 212, a third base board 213, a reduction gear set 23 provided between the first and the second base boards 211, 212, a disengaging mechanism consisting of a link 251, a spring 252, and a cam 253, and a clamp wheel set disposed between the second and the third base boards 212, 213.

Figure 4:
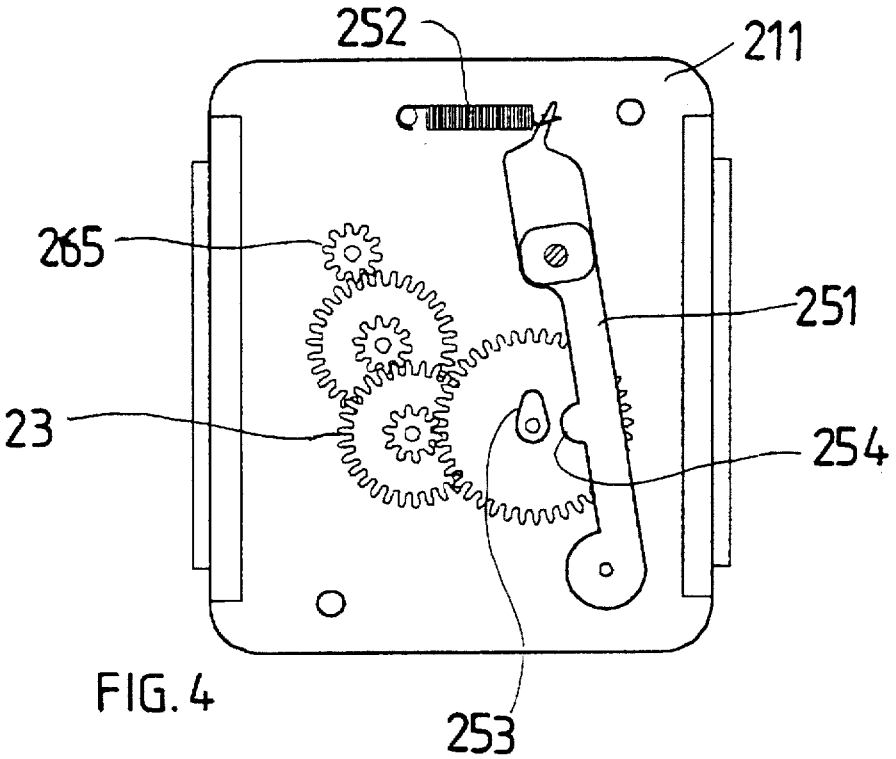
FIG. 4 is an elevational plan view showing the disengaging mechanism of the present invention.

Please refer to FIG. 4. The link 251 of the disengaging mechanism is pivotally connected at a lower end to the first base board 211. The cam 253 is mounted on the last gear of the reduction gear set 23, such that when the cam 253 rotates, it shall contact a push nose 254 projecting from an inner side surface of the link 251 and thereby pushes the link 251 outward. The spring 252 is fixedly connected at one-end to the first base board 211 and at the other end to an upper end of the link 251 opposite to the lower end thereof to provide a return force to the link 251.

Figure 3:
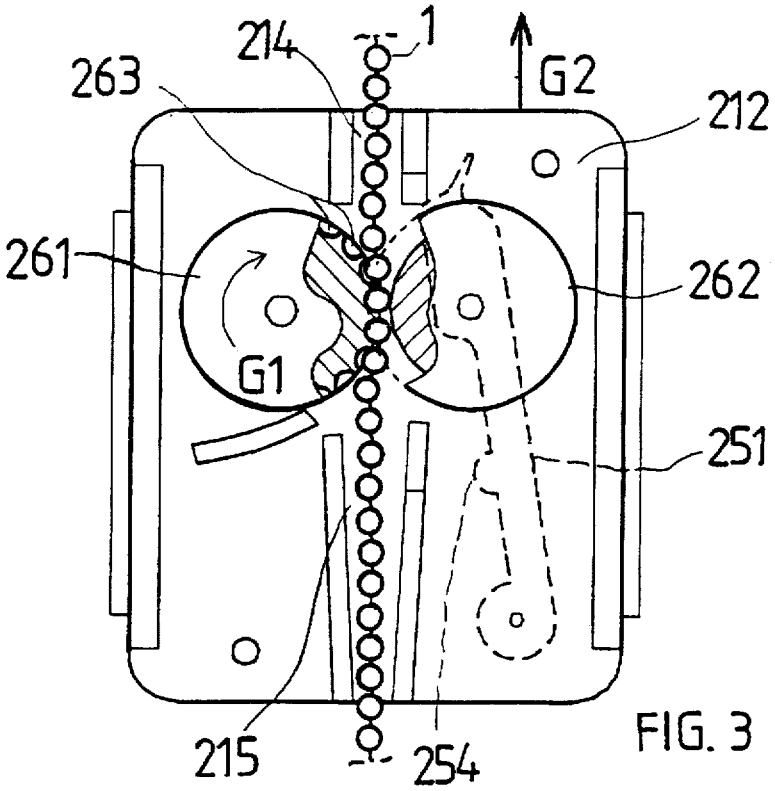
FIG. 3 is an elevational plan view showing the engagement of the clamp wheel set with the beads of the long string.

The clamp wheel set includes a first wheel 261 directly rotated by the motor 22 and a second wheel 262 which is an idler. The first wheel 261 is provided along its circumferential surface with a plurality of serially arranged semispherical recesses 263. Each of the semispherical recesses 263 fitly receives and engages with a bead 11 of the long string 1. The first and the second wheels 261, 262 together clamp the beads 11 between them. When the first wheel 261 rotates clockwise, the semispherical recesses 263 of the first wheel 261 are pushed against the beads 11 of the long string 1 one by one, bringing the whole driving mechanism 2 to move upward along the long string of beads 1, as shown in FIG. 3. The second wheel 262 is co-axially connected to the disengaging mechanism. The beads 11 form the units of the long string 1 and can be replaced with other differently shaped string units. Of course, the recesses 263 on the circumferential surface of the first wheel 261 must have a shape corresponding to that of the string units, so that each string unit can be fitly located in the recesses 263 and move out of the recesses 263 smoothly.

The whole driving mechanism 2 is enclosed in the ornamental toy 3. As shown by the phantom line of FIG. 2, the ornamental toy 3 can be a Santa Claus or any other figure.

The motor 22 is the main power source of the driving mechanism 2. The first wheel 261 of the clamp wheel set is driven by the motor 22 to rotate in a direction shown by the arrow G1 in FIG. 3, bringing the whole driving mechanism 2 to move upward along the long string of beads 1 in a direction shown by the arrow G2. Meanwhile, a small gear 265 disposed between the first and the second base boards 211, 212 and co-axially connected to the first wheel 261 shall drive the reduction gear set 23 to rotate, bringing the cam 253 connected to the reduction gear set 23 to rotate, too.

Figure 6:
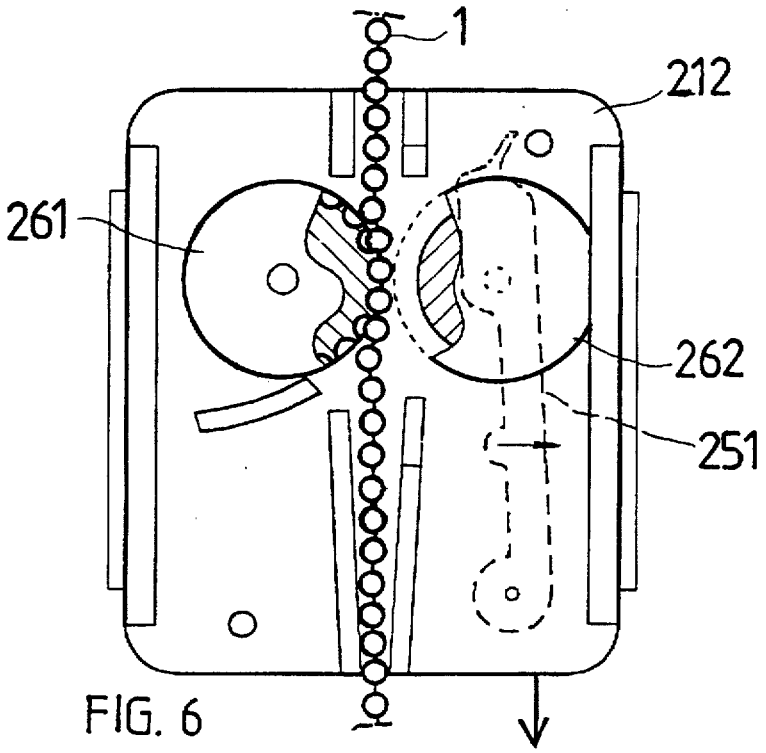
FIG. 6 illustrates the manner in which the clamp wheel set of the present invention disengages from the beads of the long string.
Figure 5:
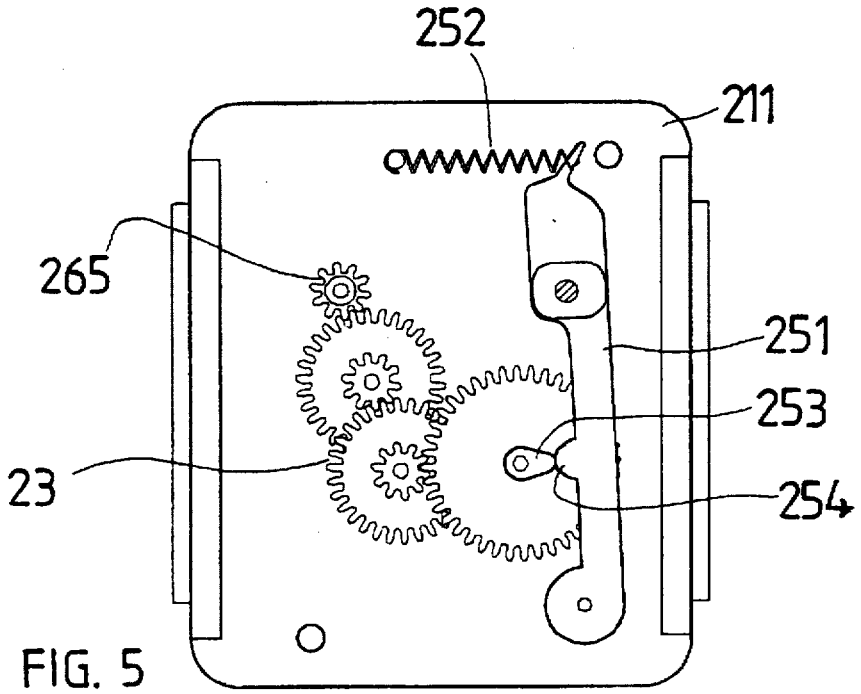
FIG. 5 illustrates the manner in which the disengaging mechanism of the present invention operates.

When the cam 253 rotates for a period of time, that is, when the driving mechanism 2 climb along the long string of beads 1 for a period of time, the cam 253 contacts with the push nose 254 of the link 251 and pushes the link 251 to move outward, as shown in FIG. 5. This makes the idler, that is, the second wheel 262 co-axially connected to the link 251, to move away from the first wheel 261 and thereby release the beads 11 of the long string 1 from the recesses 263 of the first wheel 261, as shown in FIG. 6. At this point, the driving mechanism 2 slides down along the long string of beads 1 due to its own weight. When the cam 253 disengages from the push nose 254 of the link 251, the return force provided by the spring 253 shall cause the link 251 to return it home position, bringing the second wheel 262 to get close to the first wheel 261 again and pushes the beads 11 against and into the recesses 263 on the first wheel 261, and to cooperate with the first wheel 261 to clamp the beads 11 between them again, allowing the driving mechanism 2 to climb along the long string of beads 1 once again. This allows the ornamental toy 3 wrapping the driving mechanism 2 up to automatically shift up and down reciprocatingly and looks very interesting.

To permit the ornamental toy 3 to smoothly climb, it is better to provide an upper and a lower string rails 214, 215 on the second base board 212 respectively at a position directly above and below where the bead string 1 is clamped between the first and the second wheels 261, 262. The string rails 214, 215 preferably have a length long enough for at least several beads 11 to pass in line without being stuck and becoming jammed in the rails. To further help the bead string 1 to keep in line in the string rails 214, 215 and smoothly shift up and down, an upper and a lower blocks 216, 217 are provided on the third base board 213 to project into the string rails 214 and 215, respectively.

A fixing means 12, such as a hook as shown in FIG. 1, is attached to a top end of the long string of beads 1, so that the string 1 can be hung to a high point. A stopper 13 is connected to a lower end of the string 1 to prevent the ornamental toy 3 from falling out of the string 1.

The motor 22 of the driving mechanism 2 can be provided with an extended plug 221 for plugging into a socket of a Christmas lit string to obtain power therefrom and becomes electrically connected to the lit string. This arrangement allows the ornamental toy 3 to climb along the bead string 1 with at least one lit string connected to it. With the light emitted from the lit string, the running ornamental toy 3 looks more interesting and special.

Alternatively, dry batteries can be mounted in the driving mechanism 1 to provide the motor 22 with necessary power so that the ornamental toy 3 needs not to connect with a lit string.

Figure 7:
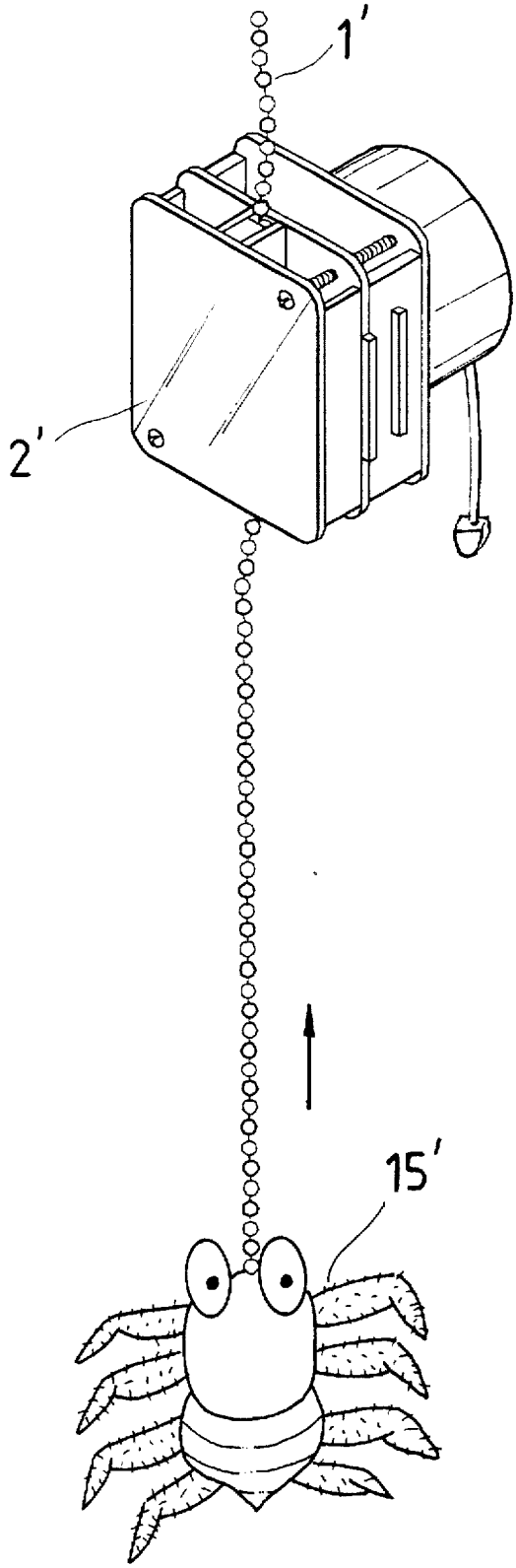
FIG. 7 illustrates another embodiment of the present invention in which the driving mechanism is in a fixed position while the long string of beads moves up and down through the driving mechanism.

FIG. 7 illustrates another embodiment of the present invention in which a driving mechanism 2' wrapped up by an ornamental toy 3' is fixedly located at a point while the long string of beads 1' movably passes through the driving mechanism 2'. A heavy ornamental article 15', such as a spider as shown in FIG. 7, is connected to a lower end of the bead string 1'. The long string of beads 1' and the heavy ornamental article 15' is pushed and shifted by the driving mechanism 2' to move upward. The driving mechanism 2' also has a disengaging mechanism. When the disengaging mechanism works, the heavy article 15' shall automatically pull the bead string 1' downward due to its weight.

What is claimed is:

1. An ornamental toy capable of running up and down, comprising:

a long string comprising a plurality of similarly shaped bead units serially connected together; and a driving mechanism comprising at least an electric motor which rotates a first or driving wheel of a clamp wheel set, said first or driving wheel being provided along a circumferential surface with a plurality of serially arranged recesses for each fitly receiving and engaging with one said bead unit of said long string, said first or driving wheel together with a second or idle wheel of said clamp wheel set tightly clamping each one said bead unit of said long string passing between said first and said second wheels and thereby brings said whole driving mechanism to shift up along said bead units one by one; said second or idle wheel being co-axially connected to a disengaging mechanism, said disengaging mechanism being actuated to work by a reduction gear set and shifting said second or idle wheel outward by a certain distance when said reduction gear set has rotated for a certain period of time, so that said long string is no longer clamped between said first and said second wheel; and an ornamental toy wrapping up said driving mechanism;

whereby when said disengaging mechanism is not actuated to work, said first and said second wheels of said clamp wheel set together tightly clamp between them said bead units of said long string passing through said clamp wheel set and bring said ornamental toy to shift upward along said long string; and when said disengaging mechanism is actuated to work, said clamp wheel set no longer tightly clamp said bead units, causing said ornamental toy to slide downward along said long string.

2. An ornamental toy capable of running up and down as claimed in claim 1, wherein said serially connected bead units of said long string are round balls and wherein said recesses on said first wheel of said clamp wheel set are semispherical recesses.

3. An ornamental toy capable of running up and down as claimed in claim 1, wherein said disengaging mechanism comprising a link which has a pivotally fixed lower end and an upper end connected to a return spring and is provided at an inner side surface with a projected nose, said second wheel of said clamp wheel set being co-axially connected to said link near said upper end of said link, and wherein said reduction gear set has a cam connected to the last gear thereof, whereby when said reduction gear set rotates, said cam connected thereto rotates at the same time and contacts with said projected nose of said link after said cam rotats for a period of time, and said contact of said cam with said projected nose of said link pushing said link to move outward which in turn causes said co-axially connected second wheel to move away from said first wheel of said disengaging mechanism.

4. An ornamental toy capable of running up and down as claimed in claim 1, wherein string guides are provided above and below said first and said second wheels at where said long string passes through, and each of said string guides having a length long enough for at least several bead units to pass in line without being stuck and becoming jammed in said string guides.

5. An ornamental toy capable of running up and down as claimed in claim 1, wherein said long string is provided at an upper end with a fixing means and at a lower end with a stopper.

6. An ornamental toy capable of running up and down as claimed in claim 1, wherein said motor of said driving mechanism is connected to a light string and has an extended plug for plugging into a socket of said light string to obtain power supply.

7. An ornamental toy capable of running up and down as claimed in claim 1, wherein said driving mechanism is provided with dry batteries to supply power to said motor.

8. An ornamental toy capable of running up and down as claimed in claim 1, wherein said driving mechanism wrapped up by said ornamental toy is fixedly located a certain point, said long string having a heavy ornamental article connected to a lower end thereof, whereby when said driving mechanism works, said long string is pushed by said clamp wheel set to move upward.

* * * * *